US008367749B2

(12) United States Patent
Aufderheide

(10) Patent No.: US 8,367,749 B2
(45) Date of Patent: Feb. 5, 2013

(54) COATED MICROSPHERES AND THEIR USES

(75) Inventor: Ronald C. Aufderheide, Delaware, OH (US)

(73) Assignee: Ask Chemicals L.P., Wilmington, DE (US)

( * ) Notice: Subject to any disclaimer, the term of this patent is extended or adjusted under 35 U.S.C. 154(b) by 598 days.

(21) Appl. No.: 12/641,935

(22) Filed: Dec. 18, 2009

(65) Prior Publication Data

US 2010/0099794 A1 Apr. 22, 2010

Related U.S. Application Data

(62) Division of application No. 11/500,019, filed on Aug. 7, 2006, now Pat. No. 7,659,327.

(60) Provisional application No. 60/707,308, filed on Aug. 11, 2005.

(51) Int. Cl.
*B22C 1/22* (2006.01)

(52) U.S. Cl. ..... 523/139; 228/101; 428/213; 428/416; 528/129; 528/145

(58) Field of Classification Search ..... 523/139; 228/101; 428/213, 416; 528/129, 145
See application file for complete search history.

(56) References Cited

U.S. PATENT DOCUMENTS

| | | | | |
|---|---|---|---|---|
| 4,713,294 | A | | 12/1987 | Armbruster et al. |
| 5,182,346 | A | * | 1/1993 | Gerber ..... 525/503 |
| 5,847,042 | A | | 12/1998 | Hosoda et al. |
| 5,869,184 | A | | 2/1999 | Oishi et al. |

FOREIGN PATENT DOCUMENTS

| | | | |
|---|---|---|---|
| JP | 06-145420 | * | 5/1994 |
| WO | WO2004/050738 | | 6/2004 |

* cited by examiner

*Primary Examiner* — Peter D. Mulcahy
*Assistant Examiner* — Henry Hu
(74) *Attorney, Agent, or Firm* — Standley Law Group LLP

(57) ABSTRACT

The invention relates to microspheres coated with a phenolic novolak resin, a process for preparing them, and their use in making foundry shapes, e.g. molds, cores, sleeves, pouring cups, etc., which are used in casting metal parts.

9 Claims, No Drawings

COATED MICROSPHERES AND THEIR USES

CLAIM TO PRIORITY AND CROSS-REFERENCE TO RELATED APPLICATIONS

This application is a divisional application of U.S. patent application Ser. No. 11/500,019 filed Aug. 7, 2006 now U.S. Pat No. 7,659,327, which claims the benefit of U.S. provisional application Ser. No. 60/707,308 filed on Aug. 11, 2005, the contents of which are hereby incorporated into this application.

TECHNICAL FIELD

The invention relates to microspheres coated with a phenolic novolak resin, a process for preparing them, and their use in making foundry shapes, e.g. molds, cores, sleeves, pouring cups, etc., which are used in casting metal parts.

BACKGROUND

The "shell process" for making foundry shapes is well known. The shell process uses a phenolic novolak resin to coat sand and hexamethylene tetramine as the curing catalyst. The coated sand is used for making foundry shapes by filling a heated pattern or corebox with the coated sand, allowing the coated sand to cure for a period of time. Then the tooling (e.g. corebox, pattern, mold, etc.) is inverted to allow the excess uncured sand to fall away, leaving a shell of cured coated sand. The process is particularly useful for producing hollow cores.

The tooling is either hot when it is filled with the coated sand or it is heated after the coated sand is added, such that the temperature of the corebox or pattern typically ranges from 200° C. to 300° C. The heat catalyzes a chemical reaction between the hexamethylene tetramine and the novolak resin and the coated sand begins to cure. The cured shell is removed from the tool and used to cast metal parts.

The sand is typically coated by two different methods. One method involves coating the sand particles with the phenolic novolak resin, which is dispersed in an organic solvent, e.g. methanol. The solvent evaporates after the phenolic novolak resin and sand are mixed. Powdered or an aqueous solution of hexamethylene tetramine is added to coated sand before the solvent has completely evaporated.

The other method involves using a solid phenolic novolak resin to coat the sand. The solid phenolic novolak resins are typically added to hot sand and mixed. The heat melts the resin, which allows the resin to coat the surface of the sand grains with the phenolic novolak resin. Thereafter, an aqueous solution of hexamethylene tetramine is mixed with the coated sand. As the mixture cools and the water evaporates, the phenolic novolak resin solidifies on the sand particles. Continued agitation of the sand particles breaks up any lumps that may have formed and forms a free-flowing mixture of coated sand grains.

All citations referred to in this application are expressly incorporated by reference.

SUMMARY

The invention relates to microspheres coated with a phenolic novolak and their use in making foundry shapes, e.g. molds, cores, sleeves, pouring cups, etc., which are used in casting metal parts.

It was surprising that phenolic novolak resins could effectively coat micropheres and that these coated microspheres could be used to make foundry shapes. For it is known that microspheres have poor heat conductivity when compared to conventional foundry grade silica sands, and that heat is required to cure foundry mixes made of phenolic novolak resins. Therefore, one would not have expected that an insulating material, such as microspheres, would be useful in the shell process because the insulating material would inhibit the transfer of heat that is necessary to both make the resin coated microspheres and to cure them in heated tooling.

There are many advantages of using foundry shapes prepared with the coated microspheres. The thermal properties of the foundry shapes can be controlled, so the solidification rate of the of the molten metal can be controlled. This reduces gas defects, miss-runs, carbides in the microstructure, and other problems.

DETAILED DESCRIPTION

Suitable resins, which can be used to prepare the coated microspheres, include phenolic novolak resins. These resins are typically prepared by reacting a phenolic compound and an aldehyde, such that the molar ratio of phenol compound to aldehyde is greater than 1.0, under acidic conditions. These resins become thermosetting when heated in the presence of a curing agent, typically hexamethylene tetramine. See for example U.S. Pat. No. 4,196,114, which is hereby incorporated by reference.

Although a variety of phenolic compounds and aldehydes can be used to prepare the resins, typically used as the phenolic compound is phenol, and typically used as the aldehyde is formaldehyde or paraformaldehyde.

Although both liquid and solid phenolic novolak resins can be used, it is preferable to use the phenolic novolak resin as a solid "flake" resin, because the process then produces less volatile organic hydrocarbons (VOC). If a solid phenolic novolak resin is used, it typically will have a melting point between 135° C. and 260° C., preferably between 149° C. and 204° C., and most preferably between 163° C. and 190° C. If a liquid phenolic novolak resin is used, it is dispersed in an organic solvent, e.g. methanol, which evaporates after the phenolic novolak resin and microspheres are mixed.

For purposes of describing this invention, phenolic novolak resins include modified phenolic novolak resins, e.g. alcohol modified phenolic novolak resins and epoxidized phenolic novolak resins.

The phenolic novolak resins may be mixed with solvents, other phenolic resole resins, and/or aqueous alkaline phenolic resole resins.

Although the phenolic novolak resin can be mixed with solvents before mixing with the microspheres, preferably it is used neat. Typical solvents that can be used for the phenolic novolak resin include non-polar or weak polar substances, e.g. aromatic solvents or fatty acid esters.

The amount of hexamethylene tetramine used to make the coated microspheres is typically from 5 to 50 weight percent based upon the weight of the coated microspheres, preferably from 10 to 30 weight percent, and most preferably from 10 to 25 weight percent.

Although any insulating microspheres can be used in the foundry mix, preferably used are hollow aluminosilicate microspheres. The weight percent of alumina to silica (as $SiO_2$) in the hollow aluminosilicate microspheres can vary over wide ranges depending on the application, for instance from 25:75 to 75:25, typically 28:72 to 43:57, where said weight percent is based upon the total weight of the hollow microspheres.

The amount of microspheres used to make the coated microspheres typically ranges from 10 to 100 percent by volume based upon the volume of the coated microspheres, preferably from 25 to 100 percent based upon the volume, and most preferably from 40 to 100 percent.

In order to mix the solid phenolic novolac with the microspheres, it is preferable to pre-heat the microspheres and/or the mixer. The temperature of the mixer typically ranges from 105° C. to 205° C., preferably from 135° C. to 150° C. The temperature of the microspheres typically ranges from 135° C. to 315° C., preferably from 200° C. to 300° C.

Depending upon the desired thermal properties of the finished foundry shape, other refractories can be added to the mixture of the shell resin and microspheres. Examples of suitable refractories include silica, magnesia, alumina, olivine, chromite, aluminosilicate, and silicon carbide among others. These refractories are preferably used in amounts less than 50 percent by volume based upon the volume of the refractory material, more preferably less than 25 percent by volume.

The mix used to make the coated microspheres may also contain internal release agents like calcium stearate, silicon oil, fatty acid esters, waxes, or special alkyd resins, which simplify the removal of the foundry shapes from the tooling. Storage of the cured foundry shapes and their resistance to high humidity can be improved by using silanes. Iron oxides can be added to the mix to control reactions between the molten metal and the coated microspheres. It is particularly useful to add salicylic acid to the phenolic novolak resin before mixing the phenolic novolak resin with the microspheres in order to promote a faster cure of the resin. Also, clays like bentonite can be added to the foundry mix to provide additional hot strength to the foundry shape.

Foundry shapes are prepared by filling heated tooling with the coated microspheres, or heating the tooling after it is filled with the coated sand. The heat activates the hexamethylene tetramine curing catalyst, so that the phenolic novolak resin cures. The temperature of the tooling typically ranges from 177° C. to 316° C., preferably from 204° C. to 250° C., and most preferably from 204° C. to 218° C. The foundry shapes are as used as molds, cores, sleeves, pouring cups, etc. in the casting of metal parts.

Abbreviations

ACC an accelerator, which helps to lower the melting point of the resin, thereby making it easier to coat the microspheres.

MIC hollow aluminosilicate microspheres having an alumina content between 28% to 43% by weight based upon the weight of the microspheres.

HMTA hexamethylene tetramine.

RESIN a phenolic novolak resin having a melting point of about 163° C. to 190° C.

Spherox a spheroid pellet of black iron oxide, $Fe_3O_4$, that is used in many sand mixes instead of regular flake black iron oxide.

SA salicylic acid, which is added to promote curing of the resin, thereby more rapidly building the thickness of the shell.

WAX calcium stearate.

EXAMPLE

The Examples will illustrate specific embodiment of the invention. These Examples are not intended to cover all possible embodiments of the invention, and those skilled in the art will understand that many variations are possible without departing from the scope of the invention. Therefore, it is intended that the invention not be limited to the particular embodiment disclosed as the best mode contemplated for carrying out this invention, but that the invention will include all embodiments falling within the scope of the appended claims. In this application all units are in the metric system and all amounts and percentages are by weight, unless otherwise expressly indicated.

Example 1

Example 1 illustrates the preparation of a foundry mix used to prepare coated microspheres with a liquid phenolic novolak resin. The formulation was prepared using the components described in Table I. The amounts are in grams and rounded off to the nearest tenth.

TABLE I

| Component | Amount |
|---|---|
| MIC | 3,178.0 |
| Spherox | 508.5 |
| RESIN | 516.1 |
| HMTA | 129.0 |
| ACC | 4.4 |
| SA | 5.1 |
| WAX | 1.8 |
| Water | 83.0 |

The components were mixed in the following manner:

A Lab Speed Muller was pre-heated to 150° C. by adding twenty-five pounds of heated sand to the mixer until the desired temperature was reached. Then the sand was removed from the mixer and seven pounds of MIC preheated to 204° C. were added to the heated Lab Speed Muller The RESIN and ACC were mixed together in a cup to ensure a uniform distribution of the ACC in the RESIN. The ACC effectively lowers the melting point of the RESIN. Then the RESIN/ACC mixture and SA were added to the heated MIC in the in Lab Speed Muller and mixed for about 1 minute. The HMTA was then added and mixed for an additional 1 minute. Thereafter, the WAX was added, and then water was added to cool down the mixture if necessary.

The mixture was then blown with air to cool the mixture to 50° C., and thereafter the mix was emptied from the mixer onto a vibrating screen, such as a 35 or 60 mesh screen, to break down the agglomerated lumps and to separate out lumps, thereby providing a more uniform distribution of particles.

Three dogbone cores about ¼ inch thick were made from the coated microspheres prepared from the formulation described in Example 1. The melting point of the coated microspheres was 97° C. as determined by using a using a Dietert tester. The average tensile strength of the dogbone cores was 85 psi after a 3-minute cure and the hot tensile was 110 psi after a 5-minute cure, as measured by measured by a dogbone hot strength tester.

Experiments indicate that the coating of the microspheres with a shell resin is much more difficult than the coating of sand with shell resins.

If necessary, the tensile strengths can be raised by increasing the mixing time and binder level.

The advantages of using microspheres as the refractory material were mentioned earlier. The microspheres allow the foundryman to adjust the thermal properties of their core and/or molding sands. This in turn can help reduce or eliminate gas blows, missruns, and other casting defects.

The invention claimed is:

1. A process for preparing microspheres coated with a phenolic novolak resin comprising:

(a) mixing a phenolic novolak resin with a refractory comprising heated microspheres;

(b) adding a catalytically effective amount of hexamethylene tetramine to said mixture; and (c) allowing the mixture of (b) to cure.

2. The process of claim 1 wherein the phenolic resin is mixed with salicylic acid before mixing the phenolic novolak resin with microspheres.

3. The process of claim 2 wherein the amount of hexamethylene tetramine is from 10 to 25 percent based on the weight of the resin.

4. The process of claim 3 wherein the amount of microspheres is from 10 to 100 percent by volume based upon the volume of the refractory.

5. The process of claim 4 wherein the microspheres are hollow aluminosilicate microspheres.

6. The process of claim 5 wherein the temperature of the heated microspheres is from 200° C. to 300° C.

7. The process of claim 6 wherein the mixer is preheated to a temperature of from 105° C. to 205° C.

8. The process of claim 7 wherein other refractories, selected from the group consisting of silica sand, chromite sand, zircon sand, and mixtures thereof, are used in addition to the microspheres.

9. Microspheres coated with a phenolic novolak resin prepared in accordance with claim 1,2,3,4,5,6,7, or 8.

* * * * *